US008602460B2

(12) United States Patent
Heuwinkel

(10) Patent No.: US 8,602,460 B2
(45) Date of Patent: Dec. 10, 2013

(54) ADAPTER FOR CONNECTING FLUID SOURCE TO WATER BED

(75) Inventor: Alexander Heuwinkel, Paderborn (DE)

(73) Assignee: Traumreiter GmbH, Paderborn (DE)

( * ) Notice: Subject to any disclaimer, the term of this patent is extended or adjusted under 35 U.S.C. 154(b) by 207 days.

(21) Appl. No.: 13/086,545

(22) Filed: Apr. 14, 2011

(65) Prior Publication Data

US 2011/0254261 A1 Oct. 20, 2011

(30) Foreign Application Priority Data

Apr. 16, 2010 (DE) ..... 10 2010 027 879

(51) Int. Cl.
*F16L 25/00* (2006.01)

(52) U.S. Cl.
USPC ..... 285/386; 285/181

(58) Field of Classification Search
USPC ..... 285/384, 181, 179, 386
See application file for complete search history.

(56) References Cited

U.S. PATENT DOCUMENTS

| | | | | | |
|---|---|---|---|---|---|
| 66,820 | A * | 7/1867 | Fitts | 285/355 |
| 232,495 | A * | 9/1880 | Hayes | 285/147.1 |
| 292,349 | A * | 1/1884 | Payne | 137/625.31 |
| 1,285,849 | A * | 11/1918 | Walling | 29/418 |
| 1,898,617 | A * | 2/1933 | Church | 285/39 |
| 2,447,947 | A * | 8/1948 | Larson et al. | 285/181 |
| 2,557,495 | A * | 6/1951 | Bily | 285/281 |
| 2,581,047 | A * | 1/1952 | Salmond et al. | 285/181 |
| 4,332,044 | A | 6/1982 | Houk | |
| 4,386,638 | A | 6/1983 | Hall et al. | |
| 4,470,164 | A | 9/1984 | Soderstrom et al. | |
| 4,673,010 | A | 6/1987 | Prufer et al. | |
| 5,090,075 | A | 2/1992 | Larson | |
| 5,127,118 | A | 7/1992 | Johenning | |
| 5,373,594 | A | 12/1994 | Johenning | |
| 5,842,241 | A | 12/1998 | Cooper et al. | |
| 5,901,392 | A | 5/1999 | Hsieh | |
| 6,114,631 | A * | 9/2000 | Gretz | 174/651 |
| 7,658,418 | B1 * | 2/2010 | Elbaz et al. | 285/153.1 |
| 7,810,851 | B2 * | 10/2010 | Wangsgaard | 285/354 |
| 7,905,746 | B2 * | 3/2011 | Brodeur | 439/446 |
| 7,909,636 | B2 * | 3/2011 | Brodeur | 439/446 |
| 2010/0008712 | A1 * | 1/2010 | Sitz et al. | 403/65 |

FOREIGN PATENT DOCUMENTS

WO 92/19133 A1 11/1992

* cited by examiner

*Primary Examiner* — Aaron Dunwoody
(74) *Attorney, Agent, or Firm* — Patent Central LLC; Stephan A. Pendorf

(57) ABSTRACT

A connector unit for connection of a fluid line to the mattress of a waterbed which unit has a first connecting piece assigned to the waterbed mattress, a second connecting piece assigned to the fluid line and a connecting sleeve which while in mounted position encompasses the first connecting piece and the second connecting piece in part at least. At least one of the connecting pieces has a thread and is provided as a screw type socket. The connecting sleeve is provided with a thread for threaded engagement with the at least one screw type socket. Just one connecting piece is threaded. The, connecting piece without thread is of flange type and provided with a flange which protrudes radially outward. The connecting sleeve has an inwardly protruding annular web to engage behind the flange of the flange type socket which is of such shape that with the sleeve in mounted position it gets at least axially clamped against the threaded connecting piece.

11 Claims, 3 Drawing Sheets

ADAPTER FOR CONNECTING FLUID SOURCE TO WATER BED

BACKGROUND OF THE INVENTION

1. Field of the Invention

This present invention relates to a connector unit for connection of a fluid line to a mattress of a waterbed which unit comprises a first connecting piece assigned to the waterbed mattress, a second connecting piece assigned to the fluid line and a connecting sleeve which while in mounted position encompasses said first and second connecting pieces in part at least wherein at least one of the connecting pieces has a thread and is provided as a screw type socket and wherein the connecting sleeve has a thread for threaded engagement with said at least one screw type socket.

2. Description of the Related Art

Prior known from EP 2 092 856 A1 is a connector unit for connecting a pump disposed outside a waterbed mattress to massage means arranged inside said mattress. The connector unit has a first connecting piece assigned to the waterbed mattress, a second connecting piece assigned to the fluid line connecting the pump to the waterbed mattress, and a connecting sleeve adapted to join the first connecting piece to the second connecting piece. Each of the two connecting pieces is provided with a male thread. Connection is established by screwing the connecting sleeve provided with female thread up on the two sockets. Assembly of the connector unit requires predetermined tolerances to be met because there are two threaded sockets provided. Moreover is the sealing of the connector unit quite complex.

It is an object of this present invention to improve a connector unit in such a way that a fluid line can be connected to the mattress of a waterbed quickly, easily and securely.

BRIEF SUMMARY OF THE INVENTION

To achieve this object the invention is characterized by the fact that just one of the connecting pieces is threaded, that the piece without thread is of flange type and provided with a flange protruding radially outward and that the connecting sleeve has an annular web protruding radially inward to engage behind said flange of the flange type socket which is shaped such that with the connecting sleeve in mounted position it gets at least axially clamped against the threaded piece.

The particular advantage of this invention resides in that due to joining a clamping type socket to a threaded piece with the aid of the connecting sleeve a connection can be obtained easily and quickly and with substantially no tolerances to be complied with. A contact face having the shape of a ring and/or ring segment is provided since the clamping type socket comprises a radially outward protruding collar and the connecting sleeve has an inwardly protruding annular web which engages around said collar while in mounted position. The size of this contact face may be easily dimensioned such that a permissible pressure per unit area is met. In addition, any relative tilting of the connecting pieces is absolutely prevented due to provision of said contact face so that faulty assembly is inhibited.

Moreover is it possible to have the connector unit dismounted easily such that the waterbed may be completely dismantled, for instance in case of a move.

A preferred embodiment of the invention provides for the threaded piece to have a male thread in some areas at least to which a connecting sleeve provided with a female thread may be screwed. It is an advantage that due to provision of such a connecting sleeve with female thread the assembly of the connector unit can be facilitated. Also may the piece with male thread and the connecting sleeve be manufactured to customary production methods. This ensures on the one hand that minor production tolerances only have to be complied with and a high degree of dimensional accuracy is afforded and that on the other hand it is possible to manufacture the threaded piece and the connecting sleeve at low cost.

According to a modification of this present invention there is a sealing means placed between the first connecting piece and a sheath of the waterbed mattress and/or between the second piece and an external safety tub that surrounds the sheath in predetermined areas at least to create a watertight bond of the first connecting piece to the sheath and/or of the second piece to said safety tub. Provision of the sealing means affords the advantage that the connector unit may be run through the safety tub and the sheath of the waterbed mattress in a watertight manner. Moreover, assembly of the connector unit is facilitated by provision of a sealing means whose geometry is adapted to the shape of the associated connecting piece and the sheath and/or of the safety tub. Needless to say that two separate sealing means may be provided of which a first one is assigned to the first connecting piece and the sheath of the waterbed mattress and the second sealing means to the second connecting piece and the safety tub.

Another modification of the invention provides for a sealing means in the form of a connecting lip that protrudes radially outward from the piece. Advantageously, said connecting lip provides a sealing face extending annularly around the socket for the purpose of sealing it against the sheath and/or the safety tub.

According to a further modification of the invention said connecting lip is integral with the connecting piece. This advantageously reduces the number of constituent parts of the connector unit such that the extent of manufacture and the manufacturing costs are cut down. Moreover is watertightness ensured between the connecting piece and the connecting lip because these components are integral.

In accordance with another modification of this invention can the lip be welded to the sheath of the waterbed mattress and the safety tub to provide watertightness. An advantage thereby afforded is that a plain and low-cost as well as quick and dependable connection of the sheath and/or safety tub to the connecting lip may thus be achieved. There is no need for any additional elements and/or materials (for example adhesives) when adopting this welding process. Damages to the sheath and/or safety tub by such additional elements or due to reaction of such additional materials with the sheath of the waterbed mattress and/or the safety tub can be avoided this way.

A further modification of this present invention provides for the first and the second connecting pieces to have a connecting neck which when in mounted position extends in axial direction in an end area facing away from the other connecting piece in each case. This connecting neck serves to join the first connecting piece to a functional component arranged inside the waterbed mattress (such as a fluid cushion, massage means or such like) and/or to connect the second connecting piece to the fluid line. Provision of this connecting neck affords the advantage that establishing the connection of the connector unit to the fluid line and/or other functional components and sealing off the connecting area will be facilitated. The fluid line may for instance be conventionally attached to the neck of the second connecting piece by means of a pipe clamp.

A still further modification of this present invention provides for a quick-action locking element to connect a functional component to the neck of the first connecting piece and/or of the fluid line to the neck of the second connecting piece. In that case can a line section of the functional component be clipped and/or screwed to the neck of the first connecting piece and/or the fluid line to the neck of the second connecting piece by means of said self-action locking element. Provision of this locking element advantageously facilitates the assembly of the connector unit. In particular can the components to be connected (functional component with line section, fluid line) be attached to the neck of a respective connecting piece quickly and dependably. Using this quick-action locking element moreover permits removal and subsequent reinstallation in the absence of any destruction or damage.

Another modification of this invention provides for the quick-action locking element to have an expansion sleeve for insertion into the end of fluid line and/or the line section of the functional component and a fixing sleeve that externally surrounds the expansion sleeve and the neck of the connecting piece in selected areas at least. In the area of the fluid line and/or the line section of the functional component said expansion sleeve has a tapered outer shell face for expanding the fluid line and/or line section in circumferential direction. It is by attaching the connecting sleeve to the neck that the end of the fluid line and/or the line section of the functional component will be clamped between the expansion sleeve and the fixing sleeve to thereby provide a seal. The fixing sleeve may for instance be clipped and/or screwed to the neck. The advantage offered by provision of said expansion sleeve and of said fixing sleeve externally fitted over said latter and over the neck of the connecting piece resides in that said line section and/or said fluid line can be easily and dependably joined with and sealed off against the connecting piece. Fluid line and line section may be fitted to and removed from the connecting piece repeatedly.

According to another modification of the invention are the first and/or the second connecting piece of an angular configuration which advantageously reduces the overall height of the connector unit such that the unit may be used even where space availability if restricted and/or where a very small overall height is demanded due to specific function or comfort conditions that may be called for in particular cases.

In accordance with a still further modification of this invention the connecting pieces and/or the connecting sleeve are produced by injection molding. This advantageously facilitates the production of these items and reduces the costs of the connector unit, especially where high production piece rates are involved.

Further advantages of this invention are as disclosed in the subclaims.

BRIEF DESCRIPTION OF THE DRAWINGS

Exemplary embodiments of the invention will now be described in closer detail with reference to the accompanying drawings.

In these drawings.

DETAILED DESCRIPTION OF THE INVENTION

A connector unit 1 serves for connection of a fluid line 2 to the mattress 3 of a waterbed. The essence of the invention in this conjunction is in a particularly easy way to vary the fill level of said waterbed mattress 3 and hence an internal pressure pi of the fluid contained inside the mattress via the connector unit to thereby influence the comfort and laying properties. It is for instance possible to vary the degree of hardness of the waterbed mattress 3 via the fill level which offers advantages in particular where persons of different height and weight are to sleep on the waterbed mattress 3 the way as usual in hotels. In addition, it is possible to connect functional components arranged inside the waterbed mattress 3, for example means for massage treatment or such like, to a pump disposed outside said mattress via the fluid line 2 by means of the connector unit 1.

Figure 1:
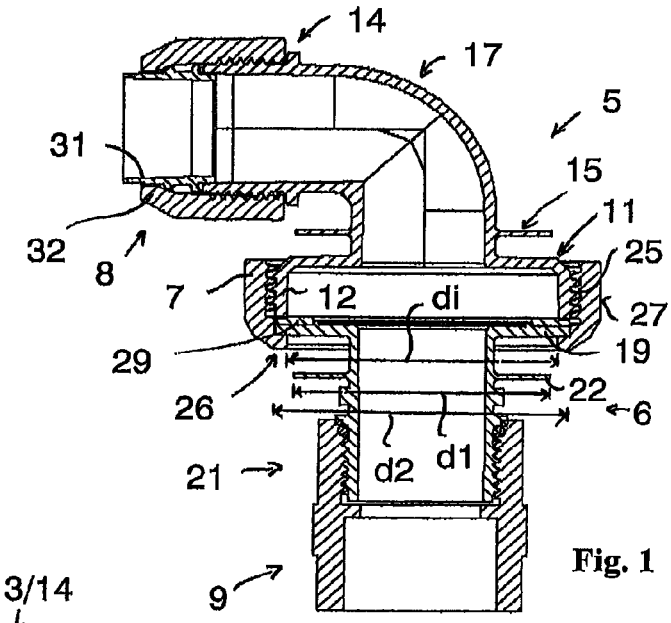
FIG. 1 is a sectional representation of a connector unit while in mounted position.
Figure 2:
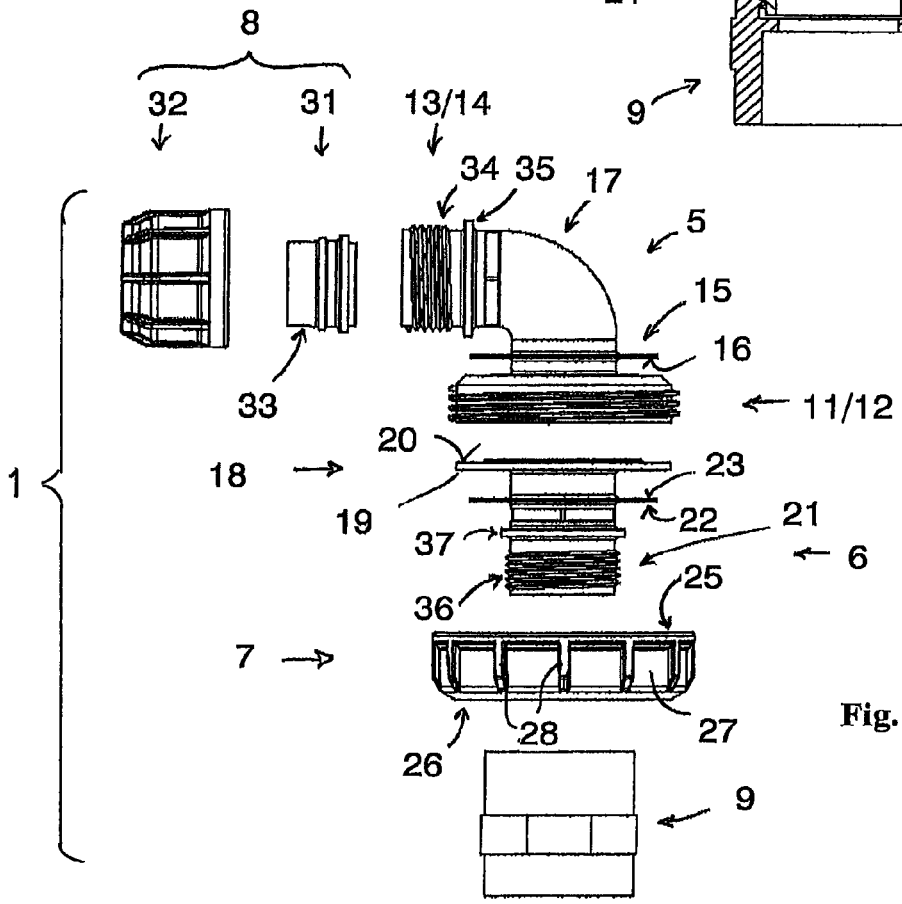
FIG. 2 is an exploded view of the connector unit according to FIG. 1.

The connector unit 1 according to FIGS. 1 and 2 substantially comprises a first connecting piece 5, a second connecting piece 6, a connecting sleeve 7 joining the first and the second connecting pieces 5, 6, a first quick-action locking element 8 assigned to the first connecting piece 5 and a second quick-action locking element 9 assigned to the second connecting piece 6.

When fitting the connector unit 1 into a waterbed the first connecting piece 5 goes with a sheath 10 of the waterbed mattress 3. Said first connecting piece 5 is of threaded type and has a male thread 12 on its end area 11 that is facing the second connecting piece 6 when in mounted position. On the end 13 of the first connecting piece 5 that is facing away from the second connecting piece 6 after mounting there is an axially extending neck 14 disposed to connect the first connecting piece 5 to a functional component 4 arranged inside the sheath 10 of the waterbed mattress 3. A sealing means 15 in the form of a connecting lip circumferentially extending around the first connecting piece 5 is provided between the male thread 12 and the neck 14. Said connecting lip 15 protrudes radially outward from said first connecting piece 5 and is integral therewith. The lip 15 serves to provide watertightness in the junction area between the first connecting piece 5 and the sheath 10 of the waterbed mattress 3, for instance by welding or bonding, for which purpose it has a substantially plane connecting face 16 for a marginal section of the sheath 10 assigned to the first connecting piece 5 to engage with.

The first connecting piece 5 is a 90° angle type socket having an elbow section 17 between the neck 14 and the lip 15. The fluid carried in the fluid line 2 is deflected within said elbow area 17. The purpose of providing the first connecting piece 5 in form of an angle type socket is to reduce the overall height of the first connecting piece 5. It is of course possible to use a first connecting piece 5 other than an angle type socket with said elbow section 15. Also may the first connecting piece 5 be angular with any optional deflection angle such as 45°, 120° or 180°. Also may the second connecting piece 6 be an angle type socket as well.

The second connecting piece 6 is a flange type socket which when in mounted position has on an end 18 instead of a male thread a radially outward protruding flange 19 with a face-end flange surface 20 that is proximal to the first connecting piece 5 to permit said flange 19 to engage with a juxtaposed structural component while on an end of the second connecting piece 6 that is facing away from the first connecting piece 5 there is a neck 21 provided for connecting the second connecting piece 6 to the fluid line 2. Another connecting lip 22 is fitted between the flange 19 and the neck 21 as a further sealing means. Just like the lip 15 of the first connecting piece 5 is said further lip 22 protruding radially outward from the second connecting piece 6 and integral therewith. Said further lip 22 has a substantially plane connecting face 23 to provide watertightness in the junction area between the second connecting piece 6 and a safety tub 24 that externally surrounds the sheath 10 of the waterbed mattress 3 in some areas at least.

The connecting sleeve 5 for joining the first connecting piece 5 with the second connecting piece 6 has a female thread 25 and on a side facing the second connecting piece 6 when mounted a radially inward protruding annular web 26. Spaced-apart ribs 28 are provided on an outer surface 27 of the connecting sleeve 7 which ensure a safe hold when the sleeve 7 is gripped and operated.

To connect the first connecting piece 5 to the second connecting piece 6 by means of said connecting sleeve 7 said latter will be placed on the second connecting piece 6 via the neck 6 and the further lip 22. The female thread 25 of the sleeve 7 is screwed together with the male thread 12 of the first connecting piece 5 to make the sleeve encompass the opposing end areas 11, 18 of the first and the second connecting pieces 5, 6. The radially inward protruding annular web 26 of the connecting sleeve 7 gets engaged behind the collar 19 of the second connecting piece 6 such that said latter gets axially clamped against the first connecting piece 5. To provide a watertight joint there is an annular seal 29 provided between the end area 11 of the first connecting piece 11 and the clamping face 20 of the second connecting piece 6.

To ensure assembling ease and functional dependability of the connector unit 1 an inner diameter di of the connecting sleeve 7 in the area of the annular web 26 is smaller than an outer diameter d1 of the second connecting piece 6 in the area of the collar 19 and larger than an outer diameter d2 of the integral lip 22 of the second connecting piece 6.

A first quick-action locking unit 8 is assigned to the neck 14 of the first connecting piece 5 and for instance serves to attach a line section 30 of a functional component 4 to the first neck 5. The locking unit 8 is for this purpose provided with an expansion sleeve 31 that is adapted for insertion into the end of the line section 30 of the functional component 4 and with a fixing sleeve 32 that surrounds the outside of said expansion sleeve 31 and the neck 14 of the first connecting piece 5 in some areas at least. The expansion sleeve 31 has an outer tapered shell face 33 assigned to the line section 30 for expanding said latter in circumferential direction. Attaching line section 30 to the neck of the first connecting piece 5 is accomplished by inserting the expansion sleeve 31 into the end section of the functional component 4 and by screwing the fixing sleeve 32 up on a male thread 34 of said neck while clamping said line section 30 between the expansion sleeve 31 and the fixing sleeve 32. A web 35 protruding radially outward from the first connecting piece 5 within the area of the neck 14 serves as a stop member making sure that the quick-action locking element 8 and the line section 30 will not be subjected to inadmissibly high loads and finally get damaged.

The second quick-action locking element 9 will be screwed up on the end of neck 21 of the second connecting piece 6 which latter has as well a male thread 36 in the area of neck 21 and a circumferential web 37 confining said male thread 36. This second quick-action locking member 8 for instance serves to connect the fluid line 2 to the second connecting piece 6.

The first connecting piece 5 with integral connecting lip 15 is preferably manufactured by injection molding a plastic material just like the second connecting piece 6 with the further connecting lip 22 is. The connecting sleeve 7 may be made by plastic injection molding as well which ensures an economic and low-tolerance production. The various threads (12, 25, 34, 36) in particular may be conveniently formed by injection molding. There is no need for any time-consuming and expensive finishing of the connecting pieces 5, 6 and/or the connecting sleeve 7.

Figure 3:
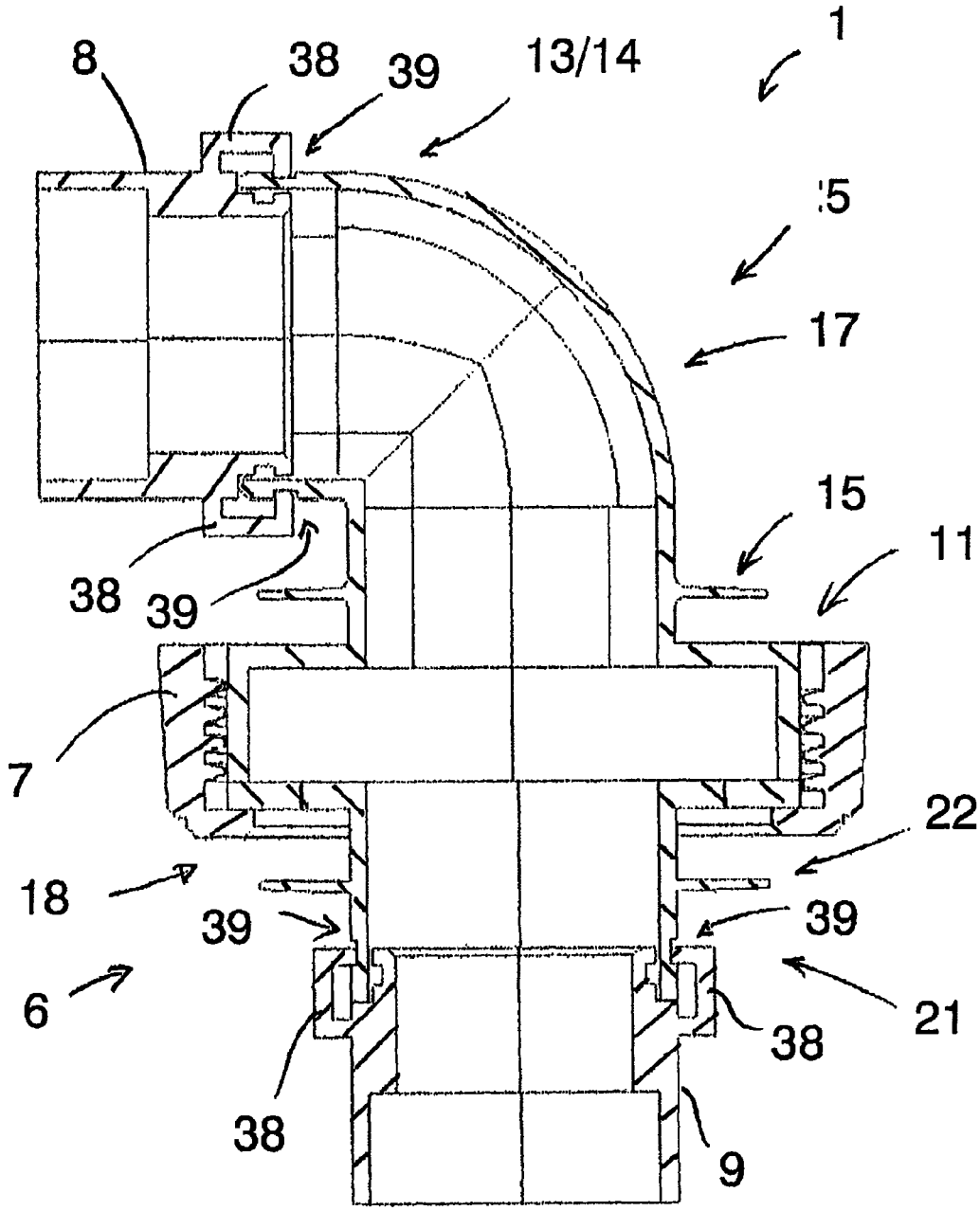
FIG. 3 shows a connector unit in a second embodiment.

An alternative embodiment of the connector unit 1 according to FIG. 3 substantially differs from the embodiment as per FIGS. 1 and 2 by the design of the first and the second quick-action locking members 8, 9 and the geometry of the necks 14, 21.

Identical components and component functions are designated by identical reference signs.

The quick-action locking member 8 can be clipped to the neck 14 of a first connecting piece 5 for which purpose it is provided with resilient snap elements 38 which engage into a recess 38 in the area of neck 14 that corresponds to the geometry of said snap elements 38 and which is for instance of an annular configuration to thereby establish connection between the quick-action locking element 8 to the first connecting piece 5. The snap elements 38 are for example integral with the said locking element.

The design of the second quick-action locking element 9 is identical with that of the first locking element 8. Said second quick-action locking element 9 is as well provided with snap elements 38 which are adapted to engage into appropriately designed recesses 39 in the neck 21 of the second connecting piece 6.

The quick-action locking elements 8, 9 according to FIGS. 1 through 3 can be combined at option.

Figure 4:
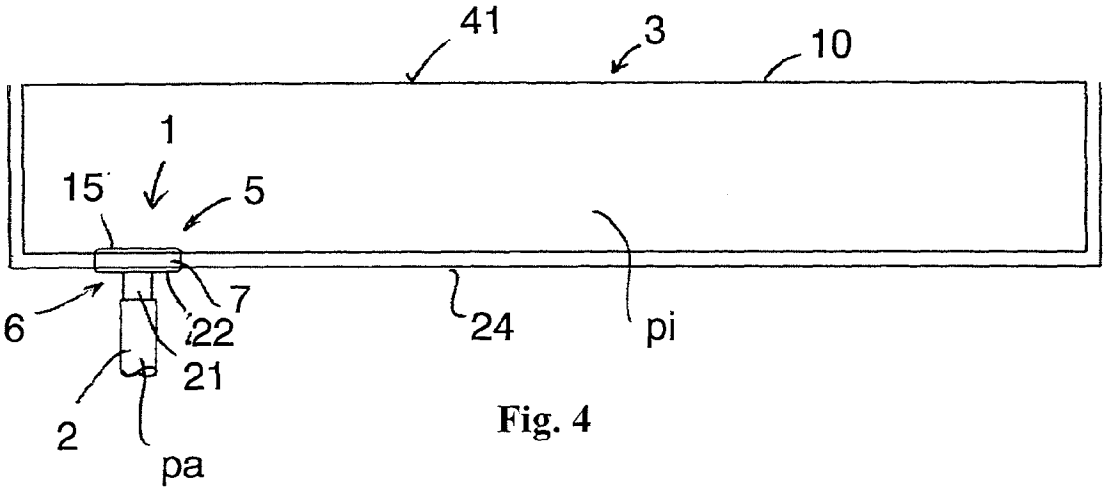
FIG. 4 is a schematic drawing of a connector unit connected to a waterbed and a fluid line.

FIG. 4 shows a connector unit 1 that is connected to the sheath 10 of the waterbed mattress 3, the safety tub 24 and the fluid line 2. The first connecting piece 5 is in that case connected to the sheath 10 of the waterbed mattress 3 via the connecting lip 15 and the second connecting piece 6 via the further lip 22 to the safety tub 24 that surrounds the exterior of the waterbed mattress 3 in some areas at least. The first and the second connecting pieces 5, 6 are joined to the connecting sleeve 7 in a customary manner. The second connecting piece 6 has a neck 21 to join it to the fluid line 2. The first connecting piece 5 is without neck because the connector unit 1 only serves for filling the waterbed mattress 3 with water in that case and not for connection of any further functional component 4 arranged inside the waterbed mattress 3.

In the configuration as shown it is possible to vary the fill level of the waterbed mattress and hence its degree of hardness by feeding water into the mattress 3 via the fluid line and/or by draining water therefrom. A watertight connection of the connector unit 1 to the sheath 10 and/or the safety tub 24 in the area of connecting lips 15, 22 is provided by welding, in particular plastic welding of sheath 10 to the connecting lip 15 assigned to the first connecting piece 5 and the safety tub 24 to the further lip 22 assigned to the second connecting piece 6.

Figure 5:
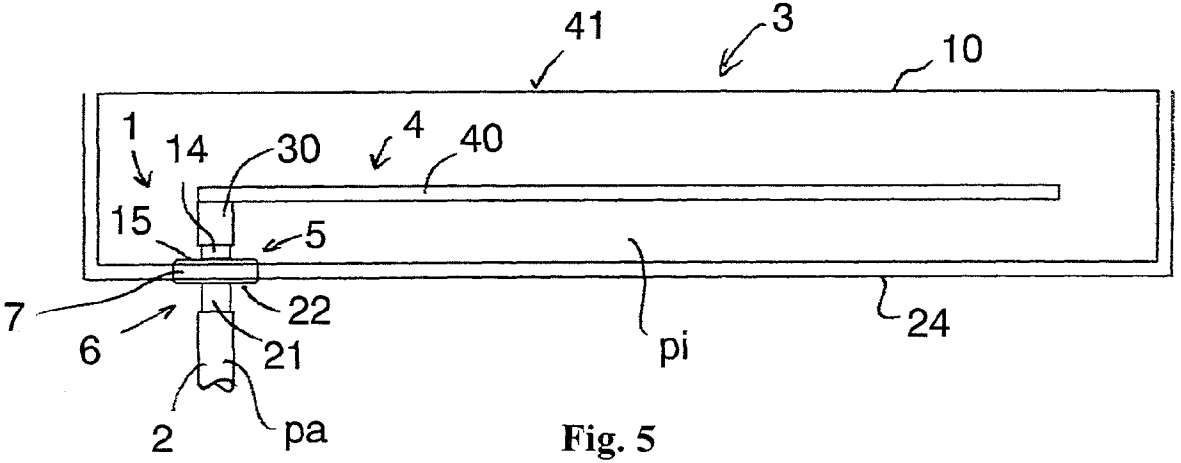
FIG. 5 is a schematic drawing of a connector unit connected to the waterbed, the fluid line and an additional functional component.

In an alternative embodiment of this invention as per FIG. 5 the connector unit 1 serves for connection of a functional component 4 arranged inside the waterbed mattress 3 to the fluid line 2. Connector unit 1 is to this end provided with a first connecting piece 5 having a neck 14 and with a second connecting piece 6 having a neck 21. Neck 14 of the first connecting piece 5 has a line section 30 of the functional component 4 which may for instance be a fluid cushion having a fluid chamber 40 that can be filled with air. Air is fed to the fluid chamber 40 of said fluid cushion 4 via the line section 40 of the cushion 4, connector unit 1 and fluid line 2 by a not-shown pump unit. By charging said fluid chamber 40 it is possible to vary the buoyancy and hence the force that supports the body of a person using the waterbed as from case to case required by the user. Moreover, the fluid chamber 40 may be used for steadying the waterbed mattress 3.

In a not-shown alternative embodiment of this invention it is possible to arrange inside the waterbed mattress 3 a means for massage treatment as functional component 4. This massage means may be used to apply a water jet to the inside of a top surface 41 of the waterbed mattress 3 in which case the connector unit 1 serves to connect the massage means 4 to a fluid line 2. Another connector unit 1 may be adopted to drain from the waterbed mattress the additional water introduced thereinto via said massage means so that a closed-circuit system is established. Moreover is it possible to provide several connector units 1 for connecting the waterbed mattress 3 to the fluid line 2 for filling the mattress with water and for connecting at least one functional component 4 disposed inside the mattress 3.

A not-shown nonreturn valve may be arranged in the area of the connector unit 1, particularly in the area of the first connecting piece 5 and/or the second connecting piece 6, or as a separate component adapted to be fitted to said connecting piece 5, 6. This nonreturn valve serves to prevent the fluid contained inside the sheath 10 of the waterbed mattress 3 from escaping therefrom when the internal pressure pi of said fluid in said sheath 10 is higher than an external pressure pa in the fluid line 2 and/or outside the waterbed mattress 3. This will ensure that the fluid remains inside the waterbed mattress 3 even when the not-shown pump is cut out and/or when the fluid line 2 is removed (dismounted) for as long as the nonreturn valve is not intentionally opened.

Just by way of example is the first connecting piece 5 assigned to the sheath 10 of the waterbed mattress shown as a threaded socket and the second connecting piece 6 associated with the safety tub 24 as a clamping type socket or vice-versa.

The sealing means provided in the form of a connecting lip 15, 22 is shown integral with connecting pieces 5, 6 just by way of example. This sealing means (lip 15, 22) may be a separate component also which is arranged between the connecting socket 5, 6 and the sheath 10 and/or the safety tub 24 and sealed off against these components. The sealing means may also be a packing sleeve made of a (rubber) flexible material.

The sealing means 15, 22 may for instance comprise two clamping elements of which the first one may be integral with the connecting piece 5, 6 and similar to the connecting lips 15, 22 protrude radially outward therefrom while the second element for instance provided in form of a nut and adapted to be screwed up on a threaded section to this end provided of the connecting piece 5, 6 is clamped against the first element in which case the marginal area of the sheath 10 and/or the safety tub 24 that is assigned to the connector unit 1 is clamped. The sheath 10 and/or the safety tub 24 is sealed against the connector unit 1 this way. Opposing clamping faces of the first and the second clamping element may have a profiled configuration to improve the sealing action and to prevent the sheath 10 and/or to the safety tub 24 from slipping out of the sealing means 15, 22. The first clamping element and/or the second clamping element may for instance be made of a metal or a plastic material.

A sealing means 15, 22 may be omitted completely where the sheath 10 and/or the safety tub 24 is direct connected to the connecting piece 5, 6, in particular by welding or bonding.

The invention claimed is:

1. A connector unit (1) for connection of a fluid line (2) to a mattress (3) of a waterbed, which mattress rests in a safety tub, which unit comprises a first connecting piece (5) assigned to said waterbed mattress (3) and including a connecting end for forming said connection, a second connecting piece (6) assigned to the fluid line (2) and including a connecting end for forming said connection, and a connecting sleeve (7) which while in mounted position encompasses said first connecting piece (5) and said second connecting piece (6) in part at least, wherein one of the connecting pieces (5, 6) has a male thread (12) at the connecting end and is provided as a screw-in connector, wherein the connecting sleeve (7) is provided with a female thread (25) for threaded engagement with the connecting end of said male threaded screw-in connector (5), wherein just one connecting piece (5) is threaded at the connecting end and the other connecting piece (6) is without thread at the connecting end, wherein the connecting piece without thread (6) is of flange type and provided with a flange (19) which protrudes radially outward, wherein the connecting sleeve (7) has a radially inwardly protruding annular web (26) to engage behind said flange (19) of the flange type socket (6) and is shaped such that with the connecting sleeve (7) in mounted position the flange (19) gets at least axially clamped against the threaded connecting piece (5), and further comprising sealing means in the form of at least one connecting lip (15, 22) that protrudes radially outward from the connecting piece (5, 6), wherein said connecting lip (15, 22) is placed between the first connecting piece (5) and a sheath (10) of a waterbed mattress (3) or between the second connecting piece (6) and a safety tub (24) of the waterbead that surrounds said sheath (10) in some areas at least to create a watertight connection between the first connecting sleeve (5) and the sheath (10) of the waterbed mattress (3) or between the second connecting piece (6) and the safety tub (24).

2. The connector unit according to claim 1, wherein the threaded socket (5) has a male thread (12) in some areas at least to which the connecting sleeve (7) with female thread (25) may be screwed.

3. The connector unit according to claim 1, further comprising sealing means in the form of a connecting lip (15, 22) that protrudes radially outward from the connecting piece (5, 6).

4. The connector unit according to claim 3, wherein each connecting lip (15, 22) is integral with its connecting piece (5, 6).

5. The connector unit according to claim 1, wherein with the unit in mounted position there is a seal (29) provided to seal off the connection between the first connecting piece (5) and the second connecting piece (6).

6. The connector unit according to claim 1, wherein a quick-action locking element (8, 9) is provided to attach the functional component (4) to the neck (14) of the first connecting piece (5) or the fluid line (2) to the neck (21) of the second connecting piece (6) such that a line section (30) of said functional component (4) can be clipped or screwed to the neck (14) of the first connecting piece (5) or the fluid line (2) to the neck (21) of the second connecting piece (6).

7. The connector unit according to claim 1, wherein the quick-action locking element (8, 9) has an expansion sleeve (31) for insertion into at least one of the end of the fluid line (2) and the line section (30) of the functional component (4) which expansion sleeve has a tapered outer shell face (33) to expand the fluid line (2)

or the line section (30) of the functional component (4) in circumferential direction, and a fixing sleeve (32) that externally surrounds the expansion sleeve (31) and the neck (14) of connecting piece (5) in some areas at least, and wherein said fixing sleeve (32) is connected to the neck (14) of connecting piece (5) to clamp the fluid line (2) or the line section (30) of the functional component (4) in place between the expansion sleeve (31) and the fixing sleeve (32).

8. The connector unit according to claim 1, wherein at least one of the first connecting piece (5) and the second connection piece (6) is angular for deflecting the fluid carried inside the fluid line.

9. The connector unit according to claim 1, wherein at least one of the connecting piece (5, 6), the connecting sleeve (7) and the connecting lip (15, 22) are manufactured by injection molding.

10. The connector unit according to claim 1, wherein at least one of the connecting piece (5, 6), the connecting sleeve (7) and the connecting lip (15, 22) is made of a plastic material.

11. A method for connection of a fluid line to the sheath (10) of a waterbed mattress (3) or for connection of a functional component (4) arranged inside the waterbed mattress (3) to the fluid line (2), the method comprising:

assigning a first connecting piece (5) to said waterbed mattress (3), the first connecting piece (5) including a connecting end for forming said connection, assigning a second connecting piece (6) to the fluid line (2), the second connecting piece including a connecting end for forming said connection, and mounting a connecting sleeve (7) which while in mounted position encompasses said first connecting piece (5) and said second connecting piece (6) in part at least, wherein one of the connecting pieces (5, 6) has a male thread (12) at the connecting end and is provided as a screw-in connector, wherein the connecting sleeve (7) is provided with a female thread (25) for threaded engagement with the connecting end of said male threaded screw-in connector (5), wherein just one connecting piece (5) is threaded at the connecting end and the other connecting piece (6) is without thread at the connecting end, wherein the connecting piece without thread (6) is of flange type and provided with a flange (19) which protrudes radially outward, wherein the connecting sleeve (7) has a radially inwardly protruding annular web (26) to engage behind said flange (19) of the flange type socket (6) and is shaped such that with the connecting sleeve (7) in mounted position the flange (19) ets at least axially clamped against the threaded connecting piece (5), further comprising sealing means in the form of at least one connecting lip (15, 22) that protrudes radially outward from the connecting piece (5, 6), wherein said connecting lip (15, 22) is placed between the first connecting piece (5) and a sheath (10) of a waterbed mattress (3) or between the second connecting piece (6) and a safety tub (24) of the waterbead that surrounds said sheath (10) in some areas at least to create a watertight connection between the first connecting sleeve (5) and the sheath (10) of the waterbed mattress (3) or between the second connecting piece (6) and the safety tub (24).

* * * * *